US010584692B2

(12) United States Patent
Mori et al.

(10) Patent No.: US 10,584,692 B2
(45) **Date of Patent: *Mar. 10, 2020**

(54) LIQUID SUPPLY SYSTEM

(71) Applicant: Eagle Industry Co., Ltd., Tokyo (JP)

(72) Inventors: Koichi Mori, Tokyo (JP); Kiyotaka Furuta, Tokyo (JP); Yoshio Osawa, Tokyo (JP)

(73) Assignee: EAGLE INDUSTRY CO., LTD., Tokyo (JP)

( * ) Notice: Subject to any disclaimer, the term of this patent is extended or adjusted under 35 U.S.C. 154(b) by 364 days.

This patent is subject to a terminal disclaimer.

(21) Appl. No.: 15/511,989

(22) PCT Filed: Sep. 18, 2015

(86) PCT No.: PCT/JP2015/076750

§ 371 (c)(1),
(2) Date: Mar. 16, 2017

(87) PCT Pub. No.: WO2016/047620

PCT Pub. Date: Mar. 31, 2016

(65) Prior Publication Data

US 2017/0298914 A1 Oct. 19, 2017

(30) Foreign Application Priority Data

Sep. 22, 2014 (JP) ..... 2014-192956

(51) Int. Cl.
*F04B 15/08* (2006.01)
*F04B 43/08* (2006.01)
*F04B 11/00* (2006.01)

(52) U.S. Cl.
CPC ..... *F04B 15/08* (2013.01); *F04B 11/005* (2013.01); *F04B 43/08* (2013.01); *F04B 43/086* (2013.01)

(58) Field of Classification Search
CPC ..... F04B 11/005; F04B 15/08; F04B 43/08; F04B 43/084; F04B 43/086; F04B 2015/082; F04B 2015/0824
See application file for complete search history.

(56) References Cited

U.S. PATENT DOCUMENTS 2,496,711 A * 2/1950 Goddard ..... F04B 15/08 417/373
3,456,595 A * 7/1969 Gottzmann ..... F04B 5/02 417/493

(Continued)

FOREIGN PATENT DOCUMENTS

DE 1653445 A1 7/1971
EP 3168550 A1 5/2017

(Continued)

OTHER PUBLICATIONS

Curbell Plastics Inc. Design Considerations for the Use of Plastic Materials in Cryogenic Enviroments. Design Considerations for the Use of Plastic Materials in Cryogenic Enviroments, Curbell Plastics, Inc, 2014. p. 15—Figure 16—Source Wisander, D., & Johnson, R., 1969 (Year: 1969).*

(Continued)

*Primary Examiner* — Devon C Kramer
*Assistant Examiner* — Joseph S. Herrmann
(74) *Attorney, Agent, or Firm* — Harness, Dickey & Pierce, P.L.C.

(57) ABSTRACT

A liquid supply system providing a stable pump operation even when ultra-low temperature liquid including slurry is set as a liquid feed target. The liquid supply system that supplies ultra-low temperature liquid including a slurry component by expansion and contraction of bellows 41 and 42. At least a region in the bellows 41 and 42 that is in contact with the liquid is coated with resin having a low (Continued)

temperature brittle temperature that is equal to or lower than an operating temperature of the liquid supply system.

4 Claims, 8 Drawing Sheets

(56) References Cited

U.S. PATENT DOCUMENTS

| | | | | |
|---|---|---|---|---|
| 3,990,816 | A * | 11/1976 | Kohler | F04B 9/042 417/536 |
| 4,365,942 | A | 12/1982 | Schmidt | |
| 4,792,289 | A * | 12/1988 | Nieratschker | F04B 15/08 417/259 |
| 4,836,756 | A | 6/1989 | Fukumoto | |
| 5,141,412 | A | 8/1992 | Meinz | |
| 5,158,439 | A | 10/1992 | Fukumoto | |
| 5,308,230 | A | 5/1994 | Moore | |
| 6,604,919 | B1 | 8/2003 | Nishio et al. | |
| 6,961,113 | B1 * | 11/2005 | Hayashi | G03F 7/70883 355/30 |
| 8,991,658 | B2 * | 3/2015 | Saito | F04B 15/08 222/146.1 |
| 9,518,577 | B2 * | 12/2016 | van Boeyen | F04B 19/24 |
| 10,233,913 | B2 * | 3/2019 | Mori | F04B 15/08 |
| 2003/0226615 | A1 * | 12/2003 | Allen | B67C 3/20 141/6 |
| 2008/0184704 | A1 * | 8/2008 | Bock | B29C 49/24 60/599 |
| 2014/0054318 | A1 | 2/2014 | Saito et al. | |
| 2015/0276131 | A1 | 10/2015 | Mori et al. | |

FOREIGN PATENT DOCUMENTS

| | | | |
|---|---|---|---|
| JP | S62-036266 | U | 3/1987 |
| JP | S63036068 | A | 2/1988 |
| JP | S64053078 | A | 3/1989 |
| JP | H06089745 | B2 | 11/1994 |
| JP | 2001-153051 | A | 6/2001 |
| KP | 2011-0057910 | A | 6/2011 |
| WO | 2012/124363 | A1 | 9/2012 |
| WO | 2014/091866 | A1 | 6/2014 |

OTHER PUBLICATIONS

Korean Office Action dated May 17, 2018 with English translation (corresponding to KR 10-2017-7007349).
Extended European Search Report dated Mar. 16, 2018 (corresponding to EP 15843832.5).

* cited by examiner

LIQUID SUPPLY SYSTEM

CROSS-REFERENCE TO RELATED APPLICATIONS

This application is a National Stage of International Application No. PCT/JP2015/076750, filed Sep. 18, 2015 (now WO 2016/047620A1), which claims priority to Japanese Application No. 2014-192956, filed Sep. 22, 2014. The entire disclosures of each of the above applications are incorporated herein by reference.

FIELD

The present disclosure relates to a liquid supply system that supplies ultra-low temperature liquid such as liquid nitrogen or liquid helium.

BACKGROUND

In order to maintain a superconductive cable or the like in an ultra-low temperature state, there has been known a technique for supplying ultra-low temperature liquid such as liquid nitrogen to a vacuum insulated tube in which the superconductive cable or the like is housed. A liquid supply (circulation) system for ultra-low temperature liquid constantly supplies the ultra-low temperature liquid into the vacuum insulated tube in order to maintain the superconductive cable in a superconductive state in an apparatus to be cooled, in which the superconductive cable is provided in the vacuum insulated tube.

The ultra-low temperature liquid circulation system has been often used assuming that only liquid is circulated. As a pump mechanism in that case, representatively, a centrifugal pump has been often used. However, as a use, it is also conceivable to transfer ultra-low temperature slurry liquid including solid particles of metal powder, stone, ceramic, and the like. An ultra-low temperature liquid circulation system adapted to the ultra-low temperature slurry liquid is demanded.

Since the centrifugal pump has a relatively low discharge pressure, it is difficult to supply high-concentration slurry. Since rotating components such as an impeller has large relative speed to slurry, the rotating components have large fictional forces and are easily worn. The rotating components bite solid particles in gaps of rotating sections to be easily locked. As a pump configuration that can realize a higher discharge pressure than the centrifugal pump, there is known a bellows pump for ultra-low temperature including a bellows member made of metal (PTL 1). However, when a liquid feed target is liquid including slurry, it is likely that the slurry hits the bellows made of metal to damage the bellows and is bitten in a bellows portion to damage a metal material.

As a liquid supply system that uses transfer liquid including a depositing material such as slurry, there is known a liquid supply system including a bellows made of resin (PTL 2). However, in the case of a pump made of resin, flexibility is poor and a stroke amount cannot be secured compared with a metal material. Therefore, it is hard to obtain pump performance necessary for supplying liquid at a large flow rate. The pump made of resin is more likely to be buckled compared with the metal material.

As measures against the slurry, there has been known a method of coating a liquid contact part of a liquid supply system with elastomer having elasticity such as rubber. Since a shock of the slurry such as solid particles is reduced by the coating having elasticity, abrasion resistance is shown against the slurry near the room temperature. However, under an ultra-low temperature environment equal to or lower than a glass transition point, since the rubber changes to a glass state and loses elasticity, the rubber does not have abrasion resistance to low-temperature slurry.

CITATION LIST

Patent Literature

[PTL 1] WO 2012/124363

[PTL 2] Japanese Patent Application Laid-open No. 2001-153051

SUMMARY

Technical Problem

An object of the present disclosure is to provide a liquid supply system that can realize a stable pump operation even when ultra-low temperature liquid including slurry is set as a liquid feed target.

Solution to Problem

In order to achieve the object, a liquid supply system in the present disclosure is a liquid supply system that supplies ultra-low temperature liquid including a slurry component by expansion and contraction of a bellows. At least a region in the bellows that is in contact with the liquid is coated with resin having a low temperature brittle temperature that is equal to or lower than an operating temperature of the liquid supply system.

The region in the bellows that is in contact with the ultra-low temperature liquid is coated with the resin having the low temperature brittle temperature lower than the system operating temperature. Consequently, when the bellows expands and contracts in a liquid supply operation of the system, the bellows is suppressed from being damaged by collision of slurry included in the liquid and a bellows surface and biting of the slurry in a bellows section. That is, since the resin coating the liquid contact region of the bellows has the low temperature brittle temperature lower than the system operating temperature, it is possible to maintain elasticity during use. The resin is deformed with respect to the collided or bitten slurry. Consequently, it is possible to suppress the bellows from being damaged.

Note that examples of the ultra-low temperature liquid include liquid nitrogen and liquid helium.

A liquid supply system in the present disclosure is a liquid supply system including: a container configured to suck liquid from a first passage communicating with an outside of the system and deliver the sucked liquid to a second passage communicating with the outside of the system; a first bellows and a second bellows disposed in series in an expanding and contracting direction in the container, respective first end portions which are on sides of the first bellows and the second bellows close to each other are respectively fixed to inner walls of the container, and respective second end portions which are on sides of the first bellows and the second bellows far from each other are respectively configured to be movable in the expanding and contracting direction; and a shaft which is inserted through the inside of the container such that the second end portions of the first bellows and the second bellows are respectively fixed to the shaft, and which expands and contracts the first bellows and the second bellows by reciprocatingly moving in the expanding and contracting direction with a driving source. An outer side of the first bellows in the container serves as a first pump chamber. The first pump chamber is provided with a first suction port for sucking the liquid into the first pump chamber from the first passage and a first deliver port for delivering the sucked liquid from the first pump chamber to the second passage. An outer side of the second bellows in the container serves as a second pump chamber. The second pump chamber is provided with a second suction port for sucking the liquid into the second pump chamber from the first passage and a second delivery port for delivering the sucked liquid from the second pump chamber to the second passage. A closed space is formed inside the first bellows and the second bellows. At least a region in the first bellows that faces the first pump chamber and a region in the second bellows that faces the second pump chamber are desirably coated with resin having a low temperature brittle temperature that is equal to or lower than an operating temperature of the liquid supply system.

In the present disclosure, the second end portions of the first bellows and the second bellows integrally move in the expanding and contracting direction of the bellows according to the reciprocating movement of the shaft. According to movement in one direction of the shaft, one of the first bellows and the second bellows contracts and the other expands, the liquid is sucked into one of the first pump chamber and the second pump chamber from the first passage, and the liquid is delivered from the other to the second passage. In the present disclosure, liquid contact parts in the first bellows and the second bellows, that is, the regions facing the first pump chamber and the second pump chamber in the pumps are coated with the resin having the low temperature brittle temperature lower than the system operating temperature. Consequently, when slurry is included in the liquid and the bellows expands and contracts in a pump operation, the bellows is suppressed form being damaged by collision of the slurry included in the liquid and bellows surfaces and biting of the slurry in bellows sections. That is, since the resin coating the liquid contact regions of the bellows has the low temperature brittle temperature lower than the system operating temperature, it is possible to maintain elasticity during use. It is possible to suppress the bellows from being damaged because bellows collides with the slurry, bites the slurry, and is deformed with respect to the slurry.

When the bellows is made of metal, heat is less easily transferred to the liquid when the coating resin is in contact with the liquid than when the bellows made of metal is directly in contact with the liquid. When a liquid feed target is ultra-low temperature liquid, it is possible to suppress a temperature rise of the liquid and maintain the liquid in a low-temperature state.

According to the present disclosure, it is possible to continuously supply the liquid alternately from the first pump chamber and the second pump chamber according to the reciprocating movement of the shaft. It is possible to perform liquid supply with pulsation suppressed. In this pump operation, when pressure acting on the inner sides (inner circumferential surfaces) of the first bellows and the second bellows does not change, it is possible to suppress buckling from occurring in the bellows. It is possible to realize a more stable pump operation.

It is desirable that at least the regions facing the first pump chamber and the second pump chamber in the container are also coated with the resin.

Consequently, it is possible to suppress damage due to the collision with the slurry included in the liquid and the heat transfer on container inner walls as well.

It is desirable that the liquid supply system further includes a third bellows disposed in series to the second bellows in the expanding and contracting direction, and having one end portion fixed to the container and the other end portion connected to the second end portion of the second bellows such that an outer side of the third bellows serves as the second pump chamber and an inner side thereof is opened to an outside of the container, the third bellows expanding and contracting according to the expansion and the contraction of the second bellows, the shaft is inserted through the inner side of the third bellows and connected to the second end portion, and a region in the third bellows that faces the second pump chamber is also coated with the resin.

Consequently, it is possible to couple the shaft and the second end portions of the respective bellows without forming a sliding part between the shaft and the container and expand and contract the respective bellows. It is possible to adopt a configuration without heat generation due to sliding friction of the shaft. In such a configuration as well, it is possible to suppress, with the coated resin, the damage due to the collision with the slurry included in the liquid and the heat transfer.

Advantageous Effects of the Disclosure

According to the present disclosure, even when ultra-low temperature liquid including the slurry is set as a liquid feed target, it is possible to realize a stable pump operation.

DRAWINGS

DETAILED DESCRIPTION

Modes for carrying out the present disclosure are illustratively explained in detail below on the basis of embodiments with reference to the drawings. However, dimensions, materials, shapes, relative dispositions, and the like of constituent components described in the embodiments are not meant to limit the scope of the present disclosure only thereto unless specifically described otherwise.

First Embodiment

Figure 1:
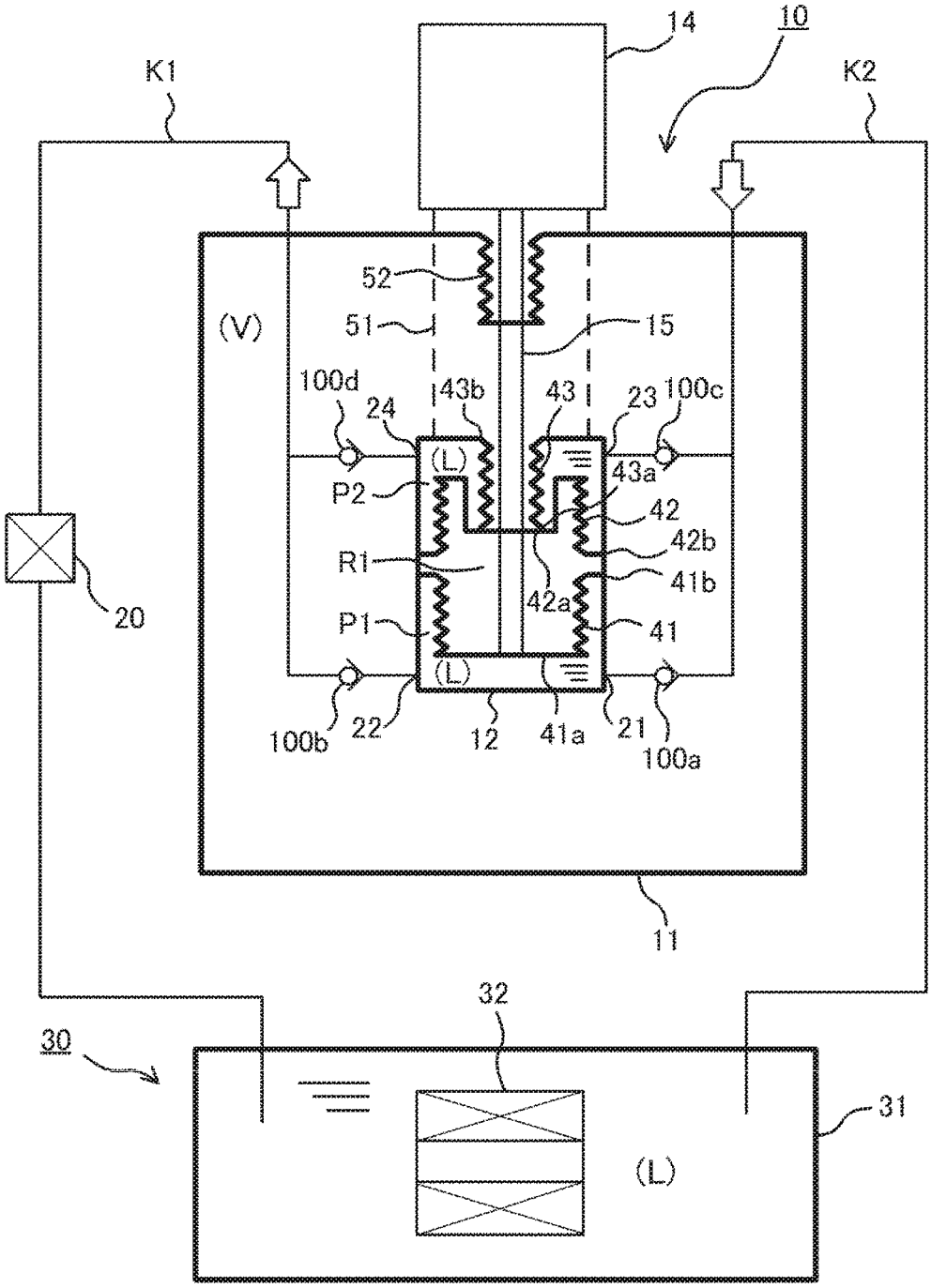
FIG. 1 is a schematic diagram showing the configuration of a liquid supply system according to an embodiment of the present disclosure.

A liquid supply system according to an embodiment of the present disclosure is explained with reference to FIG. 1. FIG. 1 is a schematic configuration diagram of the liquid supply system according to the embodiment of the present disclosure.

A liquid supply system 10 is a pump apparatus for low-temperature fluid. The liquid supply system 10 constantly supplies ultra-low temperature liquid L into a container 31 made of resin in order to maintain the superconductive cable 32 in a superconductive state in an apparatus to be cooled 30, in which a superconductive cable 32 is provided in the container 31. Specific examples of the ultra-low temperature liquid L include liquid nitrogen and liquid helium and also include liquid having temperature equal to or lower than temperature at which the liquid nitrogen and the liquid helium change to liquid.

The liquid supply system 10 generally includes a first container (an outer side container) 11 evacuated on the inside and a second container 12 disposed to be surrounded by a vacuum space on the inside of the first container 11. Three bellows 41, 42, and 43 are generally disposed in series in respective expanding and contracting directions in the second container 12. A container inside is partitioned into three closed spaces by the bellows 41 to 43. The second container 12 is supported on the inside of the first container 11 by a supporting member 51 inserted through the inside of the first container 11 from the outside of the first container 11.

The first bellows 41 and the second bellows 42 have the same diameter and are disposed side by side in series to each other in the respective expanding and contracting directions with axis centers there of matched. Respective end portions (first end portions) 41*b* and 42*b* on sides close to each other of the first bellows 41 and the second bellows 42 are fixed to the inner wall of the second container 12. Respective end portions (second end portions) 41*a* and 42*a* on sides far from each other in the first bellows 41 and the second bellows 42 are integrated by fixing a shaft 15 explained below and configured to be movable in the respective expanding and contracting directions.

The third bellows 43 is disposed side by side in series to the second bellows 42 on the opposite side of the first bellows 41. The third bellows 43 has an outer diameter smaller than the inner diameter of the second bellows 42 and is disposed such that a part thereof enters the inner side of the second bellows 42 in the expanding and contracting direction. One end portion 43*b* of the third bellows 43 is fixed to the inner wall of the second container 12 such that the inner side of the third bellows 43 is opened to the outside of the second container 12. The other end portion 43*a* of the third bellows 43 is coupled to the end portion 42*a* of the second bellows 42. The third bellows 43 expands and contracts according to expansion and contraction of the second bellows 42.

The end portion 41*a* of the first bellows 41 is closed. A closed space formed by a region on the outer side of the first bellows 41 in the second container 12 configures a first pump chamber P1. A closed space formed by a region on the outer side of the second bellows 42 and the third bellows 43 in the second container 12 configures a second pump chamber P2. A space between the end portion 42*a* of the second bellows 42 and the end portion 43*a* of the third bellows 43 is closed. A space between the end portion 41*b* of the first bellows 41 and the end portion 42*b* of the second bellows 42 is opened. In the second container 12, a region on the inner side of the first bellows 41 and a region on the inner side of the second bellows 42 configure one closed space R1.

In the second container 12, a first suction port 21 for sucking the liquid L from a return passage (a return pipe) K2 communicating with the outside of the system into the first pump chamber P1 and a first delivery port 22 for delivering the sucked liquid L from the first pump chamber P1 to a supply passage (a supply pipe) K1 communicating with the outside of the system are provided. In the second container 12, a second suction port 23 for sucking the liquid L from the return passage K2 into the second pump chamber P2 and a second delivery port 24 for delivering the sucked liquid L from the second pump chamber P2 to the supply passage K1 are also provided. Check valves 100*a* and 100*c* are respectively provided in the first suction port 21 and the second suction port 23. Check valves 100*b* and 100*d* are respectively provided in the first delivery port 22 and the second delivery port 24 as well.

The shaft 15 configured to reciprocatingly move by a linear actuator 14 functioning as a driving source enters the inside of the closed space R1 of the second container 12 from the outside of the first container 11 through the inner side of the third bellows 43. The end portion 41*a* of the first bellows 41 and the end portion 42*a* of the second bellows 42 are respectively fixed. Consequently, the shaft 15 reciprocatingly moves, whereby the respective bellows expand and contract.

The shaft 15 is inserted through the inside from the outside of the first container 11 via a bellows 52 provided in the first container 11. One end of the bellows 52 is fixed to the first container 11. The other end of the bellows 52 is fixed to the shaft 15. The bellows 52 is configured to expand and contract according to the reciprocating movement of the shaft 15.

Figure 2:
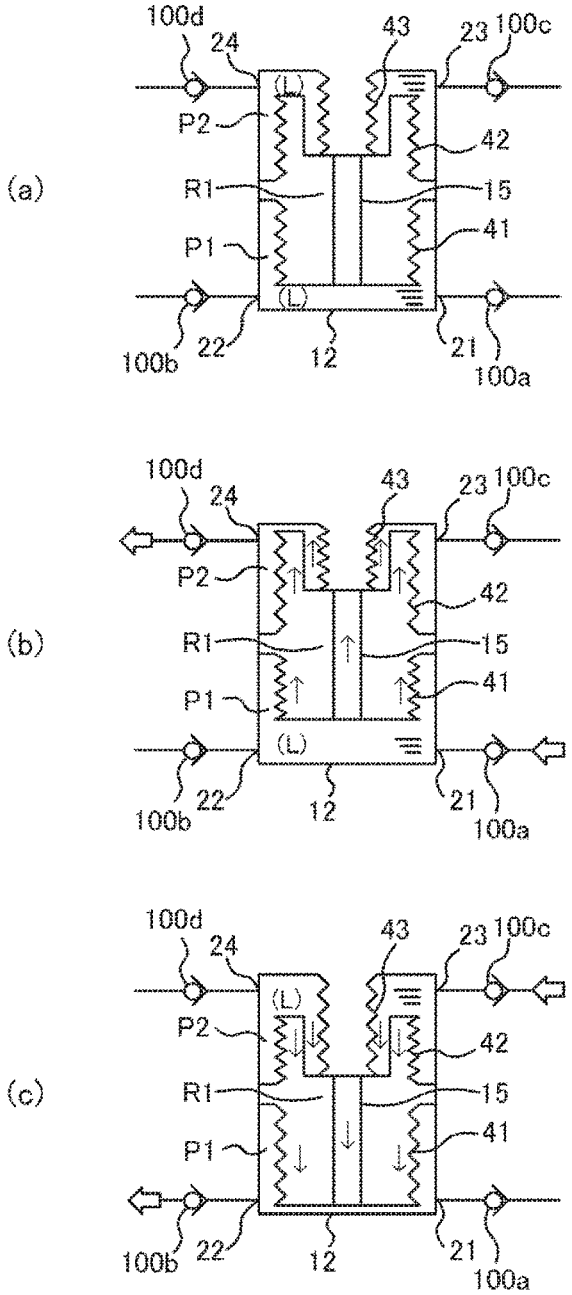
FIG. 2 is a schematic diagram for explaining the operation of the liquid supply system according to the embodiment of the present disclosure.

The operation of the liquid supply system 10 is explained with reference to FIG. 2. FIG. 2 is a schematic diagram for explaining the operation of the liquid supply system according to the embodiment of the present disclosure. FIG. 2(*a*) is a diagram showing the inside of the second container 12 in a state in which the bellows 41 and 42 are not displaced neither in an expanding direction nor in the contracting direction. FIG. 2(*b*) is a diagram showing the inside of the second container 12 in a state at the time when the liquid L is sucked into the first pump chamber P1 from the return passage (a first passage) K2 and the liquid L is delivered from the second pump chamber P2 to the supply passage (a second passage) K1, that is, a state in which the first bellows 41 contracts to the maximum and a state in which the second bellows 42 expands to the maximum. FIG. 2(*c*) is a diagram showing the inside of the second container 12 in a state in which the liquid L is sucked into the second pump chamber P2 from the return passage (the first passage) K2 and the liquid L is delivered from the first pump chamber P1 to the supply passage (the second passage) K1, that is, a state in which the first bellows 41 expands to the maximum and a state in which the second bellows 42 contracts to the maximum.

When the shaft 15 moves (FIG. 2(*a*) to FIG. 2(*b*) such that the first bellows 41 contracts and the second bellows 42 expands, the liquid L is delivered from the second pump chamber P2 to the supply passage K1 via the second delivery port 24 and the liquid L is sucked into the first pump chamber P1 via the first suction port 21. When the shaft 15 moves (FIG. 2(*b*) to FIG. 2(*a*) to FIG. 2(*c*)) such that the first bellows 41 expands and the second bellows 42 contracts, the liquid L is sucked into the second pump chamber P2 via the second suction port 23 and the liquid L is delivered from the first pump chamber P1 to the supply passage K1 via the first delivery port 22. In this way, the liquid L is delivered to the supply passage K1 in both the directions at the time when the shaft 15 reciprocatingly moves.

Figure 3:
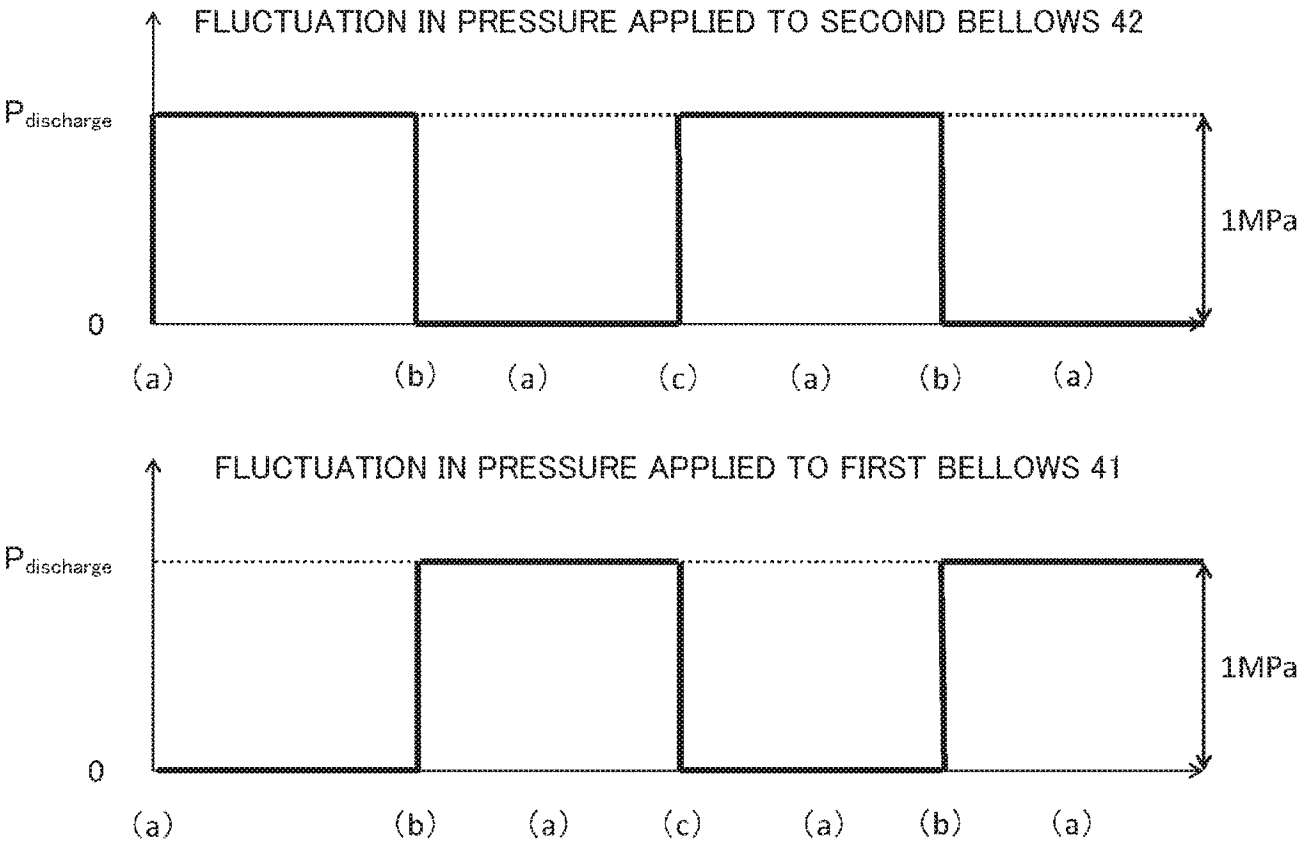
FIG. 3 is a diagram showing fluctuation in a discharge pressure of the liquid supply system according to the embodiment of the present disclosure.

The upper side of FIG. 3 is a diagram schematically showing fluctuation in pressure applied to the second bellows 42 of the liquid supply system according to the first embodiment. The lower side of FIG. 3 is a diagram schematically showing fluctuation in pressure applied to the first bellows 41 (pressure at the time when the liquid is not discharged from the pump chamber is neglected for convenience). In this embodiment, the closed space R1 is a vacuum space. Therefore, the pressure applied to the second bellows 42 of the liquid supply system 10 according to this embodiment fluctuates to alternately change between zero and a maximum discharge pressure (P discharge) as shown in FIG. 3 according to the expansion and the contraction of the respective bellows by the reciprocating movement of the shaft 15. FIG. 3 shows pressure fluctuation at the time when the maximum discharge pressure (P discharge) is 1 MPa. In FIG. 3, (a) corresponds to a displacement position of the shaft 15 in FIG. 2(*a*), (*b*) corresponds to a displacement position of the shaft 15 in FIGS. 2(*b*), and (*c*) corresponds to a displacement position of the shaft 15 in FIG. 2(*c*). The pressure applied to the bellows 41 and 42 is a differential pressure between the pressure outsides the bellows and the pressure inside the bellows. In a state without displacement of the shaft 15 before the start of the apparatus, the liquid is not sucked into and discharged from the pump chambers. There is no difference between the external pressure and the internal pressure of the bellows 41 and 42. Therefore, the pressure applied to the bellows is 0. As the state is closer to (b) (the first pump chamber P1 discharges the liquid and the second pump chamber P2 sucks the liquid), the pressure applied to the second bellows 42 increases. When the outside of the bellows has the maximum discharge pressure (P discharge), the pressure applied to the second bellows 42 increases to the maximum (P discharge). As the state is closer to (c) (the first pump chamber P1 sucks the liquid and the second pump chamber P2 discharges the liquid), the pressure applied to the second bellows 42 decreases. Since the suction pressure is 0, the pressure applied to the second bellows 42 decreases to 0. Note that the pressure fluctuation shows the same behavior in the first bellows 41 except that only a phase is different.

As explained above, in the liquid supply system 10, the liquid L is supplied to the apparatus to be cooled 30 through the supply passage K1 according to the repetition of the reciprocating movement of the shaft 15 and the expanding and contracting motion of the bellows. The liquid L returns to the liquid supply system 10 by an amount supplied to the apparatus to be cooled 30 through the return passage K2 that connects the liquid supply system 10 and the apparatus to be cooled 30. A cooler 20 that cools the liquid L to an ultra-low temperature state is provided halfway in the supply passage K1. With this configuration, the liquid L cooled to the ultra-low temperature by the cooler 20 circulates between the liquid supply system 10 and the apparatus to be cooled 30.

As explained above, the liquid supply system 10 includes the two pump chambers and the fluid is alternately supplied from the two pump chambers. Therefore, the liquid L is delivered to the supply passage K1 in both of the contraction and the expansion of the respective bellows. A liquid supply amount by the expanding and contracting motion of the respective bellows can be increased to a double compared with, for example, when the pump function is exhibited by only the first pump chamber P1. Therefore, a supply amount for one time can be reduced to a half with respect to a desired supply amount compared with when the pump function is exhibited by only the first pump chamber P1. The maximum pressure of the liquid in the supply passage K1 can be reduced to approximately a half. Therefore, it is possible to suppress an adverse effect due to pressure fluctuation (pulsation) of the supplied liquid.

The capacity of the closed space R1 formed on the inner side of the first bellows 41 and the second bellows 42 does not change even if the first bellows 41 and the second bellows 42 expand and contract (because the sectional areas of the internal spaces of expanding and contracting portions of both the bellows are equal). Internal pressure acting on the first bellows 41 and the second bellows 42 (pressure acting on the inner circumferential surfaces of the respective bellows) does not change in the space. That is, in the liquid supply system 10 according to this embodiment, the pump chambers are disposed on the outer side of the respective bellows and buckling due to internal pressure fluctuation of the bellows does not occur. Therefore, in withstanding pressure design of the bellows, since it is unnecessary to take into account internal pressure buckling, design flexibility is improved and an increase in a discharge pressure can be achieved. This advantage of this embodiment is explained in comparison with a conventional example with reference to FIG. 5 and FIG. 6.

Figure 5:
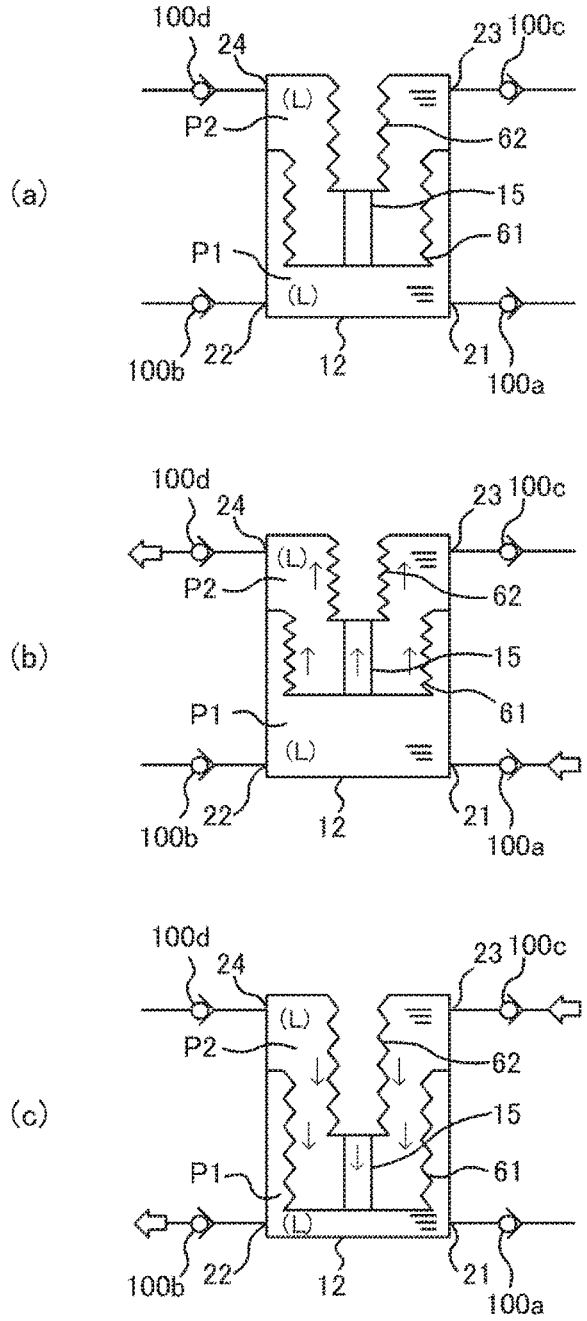
FIG. 5 is a schematic diagram for explaining the operation of a liquid supply system according to a conventional example.

FIG. 5 is a schematic diagram for explaining the operation of a liquid supply system according to the conventional example. As shown in FIG. 5, in the liquid supply system according to the conventional example, two pump chambers P1 and P2 are respectively formed on the inner side and the outer side of a bellows 61. That is, when bellows 61 and 62 contract according to the movement of the shaft 15 (FIG. 5(*a*) to FIG. 5(*b*)), the liquid L is delivered from the second pump chamber P2 to the supply passage K1 via the second delivery port 24 and the liquid L is sucked into the first pump chamber P1 via the first suction port 21. When the bellows 61 and 62 expand according to the movement of the shaft 15 (FIG. 5(*b*) to FIG. 5(*a*) to FIG. 5(*c*)), the liquid L is sucked into the second pump chamber P2 via the second suction port 23 and the liquid L is delivered from the first pump chamber P1 to the supply passage K1 via the first delivery port 22.

Figure 6:
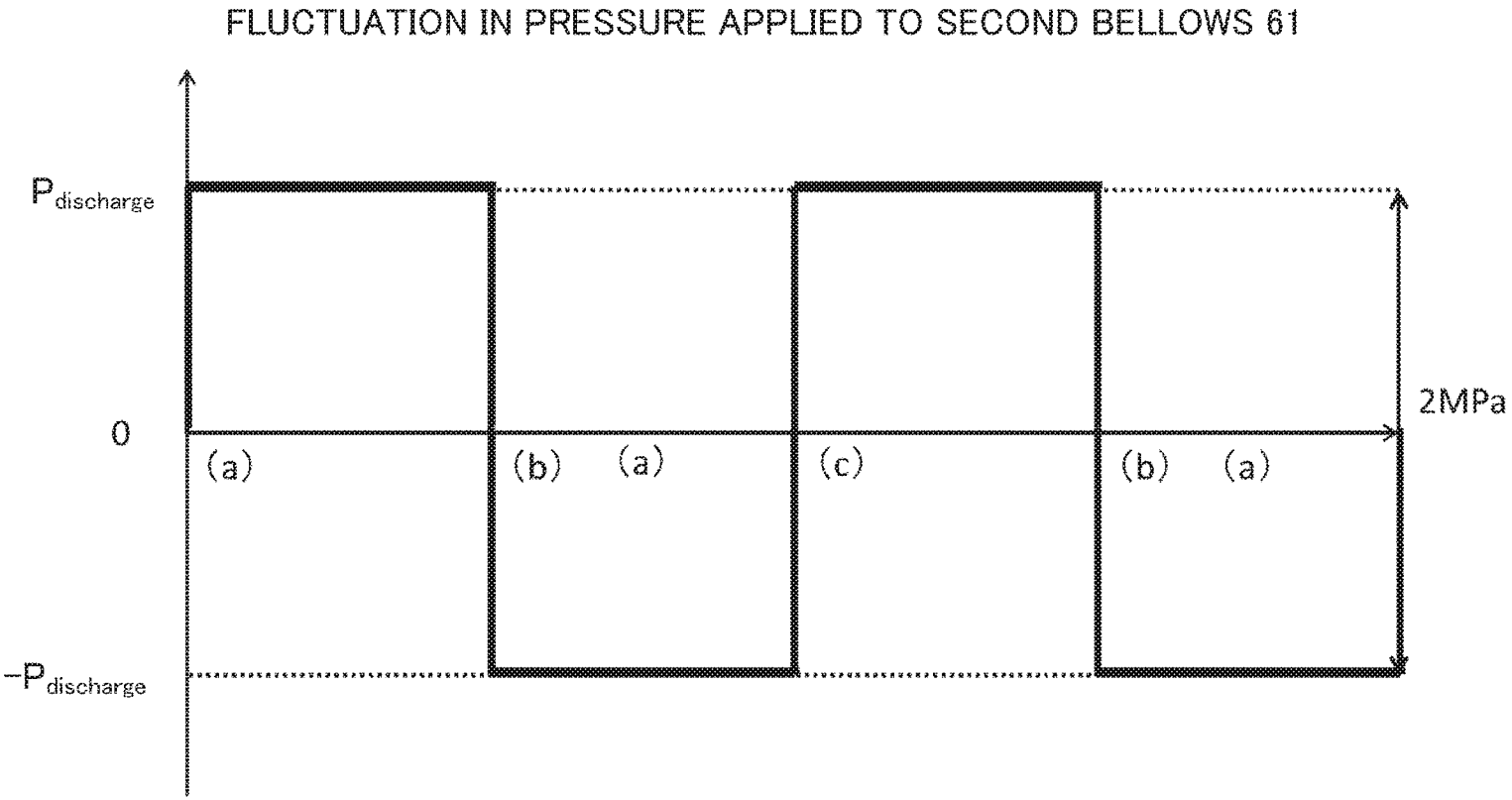
FIG. 6 is a diagram showing fluctuation in a discharge pressure of the liquid supply system according to the conventional example.

FIG. 6 is a diagram showing fluctuation in a discharge pressure of the liquid supply system according to the conventional example. Note that, in the figure, pressure applied in an outward direction of the bellow 61 is positive and pressure applied in an inward direction of the bellows 61 is negative (pressure at the time when the liquid is not discharged from the pump chambers is neglected for convenience of explanation). As shown in FIG. 6, in the configuration of the conventional example, when the liquid L is alternately discharged from the first pump chamber P1 and the second pump chamber P2, a discharge pressure (P discharge) of the same magnitude alternately acts respectively on the inner side and the outer side of the bellows 61. That is, the discharge pressure (P discharge) is applied in the inward direction and the outward direction of the bellows. Therefore, when a configuration for obtaining the maximum discharge pressure (1 MPa) same as the maximum pressure in this embodiment is considered, pressure fluctuation of the discharge pressure is a double of the pressure fluctuation in the configuration of this embodiment (FIG. 3 and FIG. 6).

Therefore, withstanding pressure performance requested of the bellows 61 is also a double of the withstanding pressure performance of the bellows in this embodiment. In the conventional example, since the internal pressure acts on the bellows 61, if it is attempted to increase the discharge pressure, the internal pressure acting on the bellows 61 also increases. Buckling easily occurs in the bellows 61. In general, the bellows is robust against external pressure but is susceptible to internal pressure. Buckling easily occurs if high internal pressure acts.

In this way, according to this embodiment, since the pressure acting on the respective bellows is only the external pressure, compared with the configuration of the conventional example in which the internal pressure acts on the bellows, it is possible to achieve an increase in the pump discharge pressure and it is possible to improve stability of the expanding and contracting motion of the bellows. Therefore, it is possible to reduce the number of circulators disposed on a cable. Since the liquid can be supplied even if there is a difference of elevation in geographical features, flexibility of cable laying is improved.

Further, in this embodiment, the structure is adopted in which the second container 12 is surrounded by the vacuum space in the first container 11. Therefore, since the vacuum space surrounding the second container 12 exhibits a function of preventing heat transfer, it is possible to suppress heat generated by the linear actuator 14 and the atmospheric heat from being transferred to the liquid L. That is, heat exchange of the liquid L is limited to radiant heat from the wall surface of the first container 11 and heat transfer via the supporting member 51 of the second container 12 and the passages. It is possible to reduce intrusion heat into the liquid L. Even if the heat is transferred to the liquid L and the liquid L is vaporized, since new liquid L is constantly supplied and a cooling effect is obtained, it is possible to suppress the temperature of the liquid L from rising to the vaporizing temperature inside the pump chambers. Therefore, the pump performance is not deteriorated.

In this embodiment, the shaft 15 is inserted through the inside of the second container 12 and coupled to the respective bellows via the end portion 43*a* on the opposite side of the end portion 43*b* fixed to the second container 12 in the third bellows 43. The third bellows 43 is configured to expand and contract according to the reciprocating movement of the shaft 15. Therefore, the pump chambers P1 and P2 and the closed space R1 are formed without a sliding part being formed between the shaft 15 and the second container 12. Therefore, heat is not generated according to frictional resistance due to sliding.

In this embodiment, the outer diameter of the third bellows 43 is smaller than the inner diameter of the second bellows 42. The third bellows 43 is disposed such that at least a part thereof enters the inner side of the second bellows 42. The entering portion can also be used as a pump space. Therefore, it is unnecessary to increase a space. It is possible to reduce the size of the second container 12.

In this embodiment, since the closed space R1 is the vacuum space, the closed space R1 may be configured to communicate with the vacuum space around the second container 12.

In this embodiment, the closed space R1 is the vacuum space. However, a configuration may be adopted in which the closed space R1 is filled with gas.

As the gas encapsulated in the closed space R1, for example, gas less easily causing a state change such as liquidation and freezing in an environment of use of this system such as neon gas and helium gas is used. The pressure of the gas encapsulated in the closed space R1 is set in a range of pressure from a vacuum (−100 kPa) to a desired discharge pressure (desirably, a half of the discharge pressure).

Figure 4:
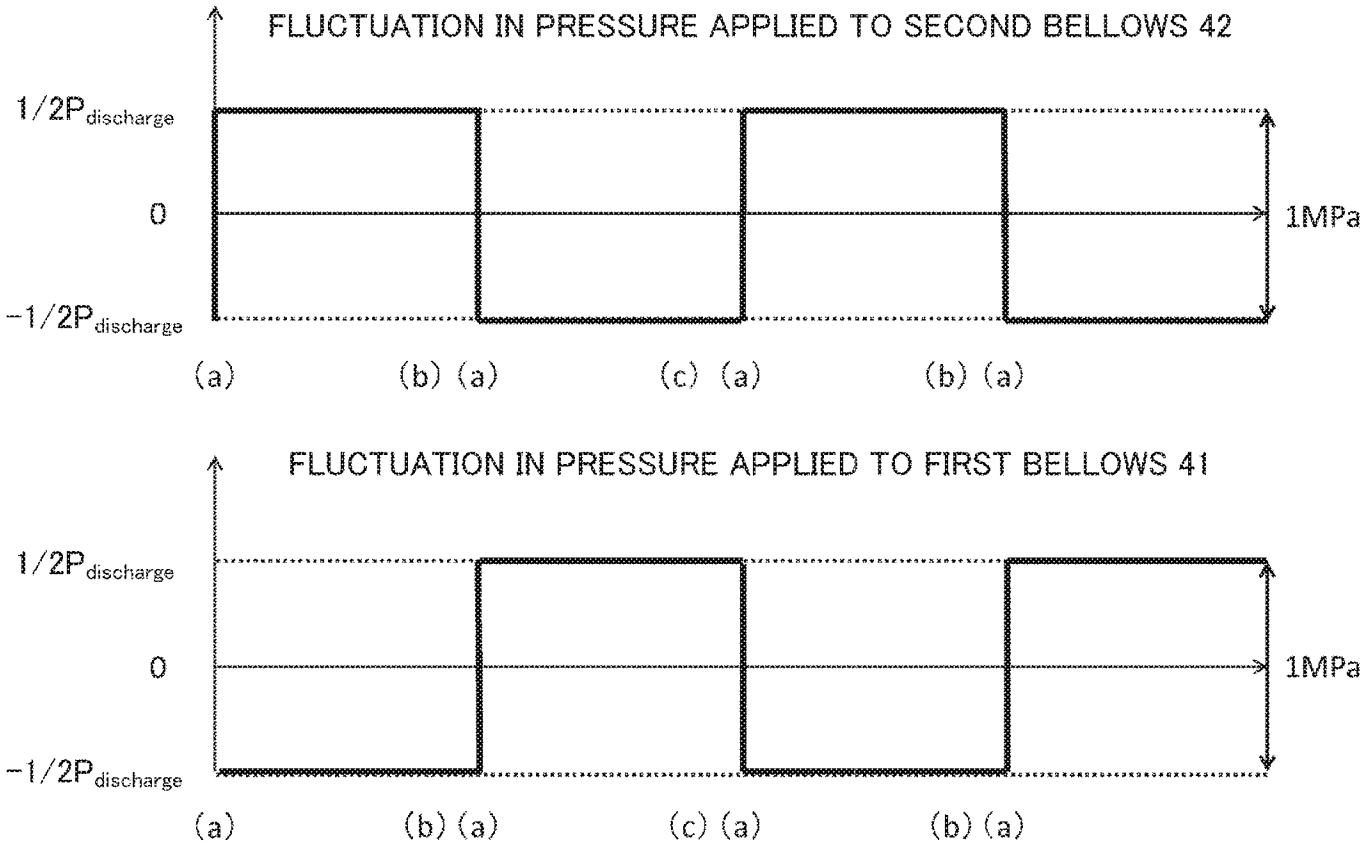
FIG. 4 is a diagram showing fluctuation in a discharge pressure of a liquid supply system according to a modification of the embodiment of the present disclosure.

FIG. 4 is a diagram schematically showing fluctuation in a discharge pressure of a liquid supply system according to a modification. The upper side shows pressure fluctuation applied to the second bellows 42 and the lower side shows pressure fluctuation applied to the first bellows 41. FIG. 4 shows fluctuation in a discharge pressure in the case in which gas having half pressure of the discharge pressure (P discharge) is encapsulated in the closed space R1 (pressure at the time when the liquid is not discharged from the pump chambers is neglected for convenience of explanation). Fluctuation width of the discharge pressure is 1 MPa same as the fluctuation width in the first embodiment. However, a peak value is a half of the peak value in the first embodiment. The pressure applied to the bellows is a pressure difference between the internal pressure of the closed space R1 and the pressure of the spaces of the respective pump chambers P1 and P2. Therefore, when the gas having the half pressure of the discharge pressure is encapsulated in the closed space R1, the pressure applied to the bellows is calculated as (½) P discharge from P discharge−(½) P discharge because the maximum pressure of the pump chambers is the P discharge. The pressure in the closed space R1 is not limited to the (½) P discharge and can be set as appropriate according to specifications such as the sizes of the two bellows and the sizes of the two pump chambers. By pressurizing the inner side of the bellows 41 and 42 with the encapsulated gas in this way, it is possible to reduce the peak value of the pressure acting on the bellows 41 and 42. Therefore, it is possible to improve design flexibility in high-pressure design for increasing the pump discharge pressure.

Figure 7:
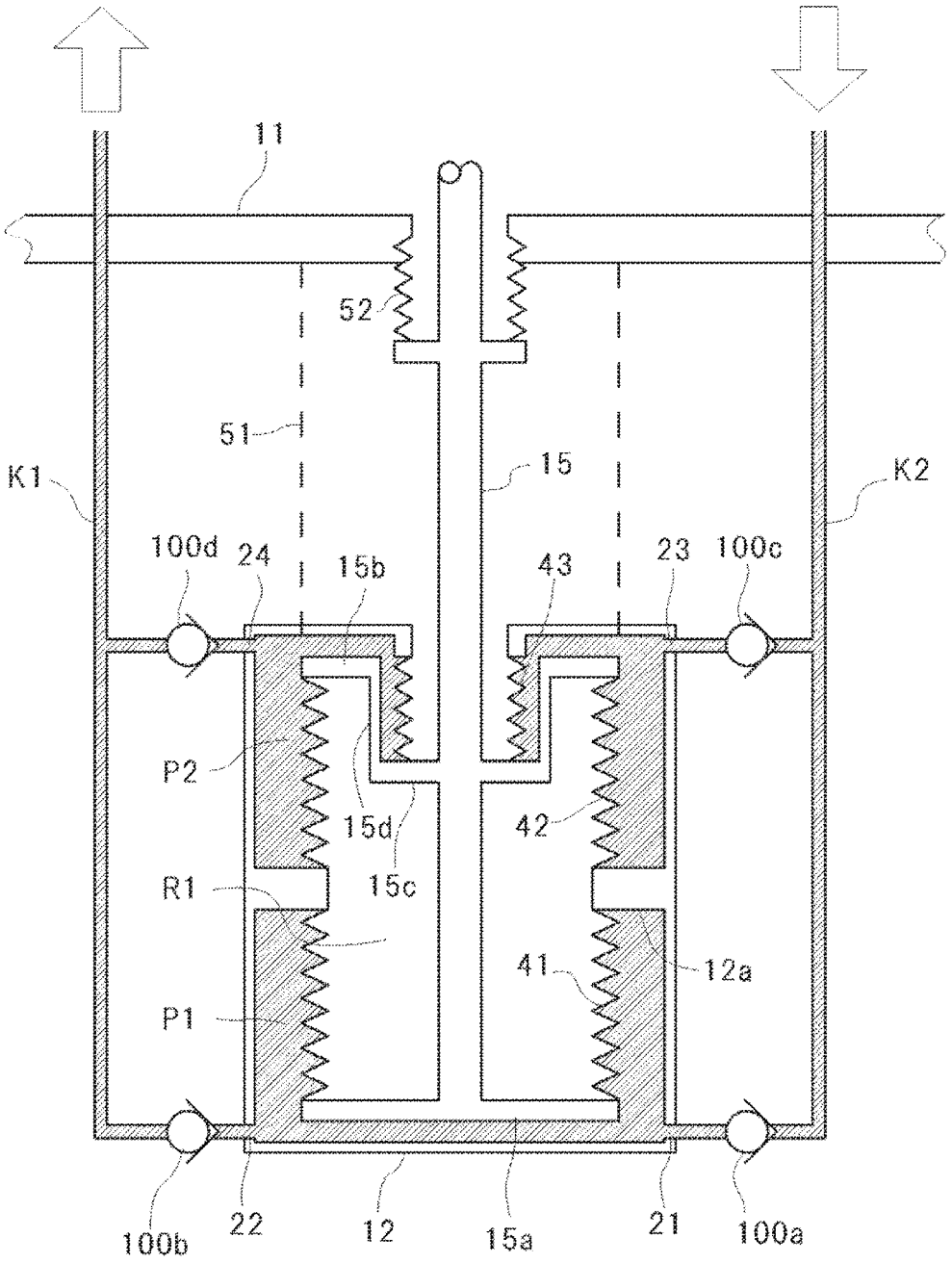
FIG. 7 is a schematic diagram showing a liquid contact region in the liquid supply system according to the embodiment of the present disclosure.
Figure 8:
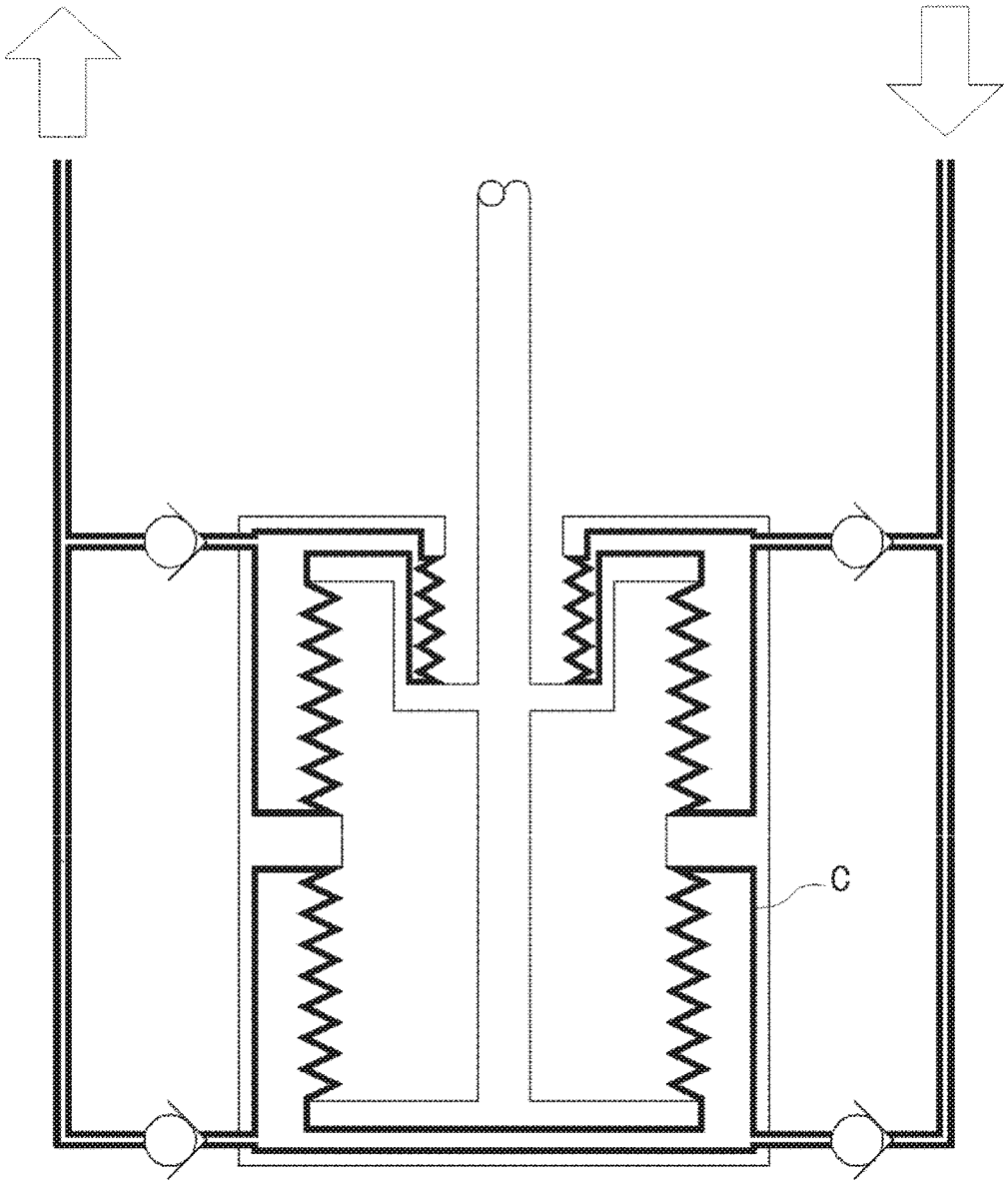
FIG. 8 is a schematic diagram showing a resin coating region in the liquid supply system according to the embodiment of the present disclosure.

A characteristic configuration of this embodiment is explained with reference to FIG. 7 and FIG. 8. FIG. 7 is a schematic diagram showing a liquid contact region in the liquid supply system according to the embodiment of the present disclosure. FIG. 8 is a schematic diagram showing a resin coating region in the liquid supply system according to the embodiment of the present disclosure. In FIG. 7, a region indicated by hatching is a circulation region of the liquid L in the liquid supply system 10 according to this embodiment. In FIG. 8, a region indicated by a thick line is a liquid contact region (a resin coating region C) with the liquid L in the liquid supply system 10 according to this embodiment.

The liquid supply system 10 according to this embodiment is characterized in that liquid contact parts in the components of the system are coated with resin. As the resin to be coated, resin that can exhibit abrasion resistance even under an ultra-low temperature environment, that is, resin having a low temperature brittle temperature lower than a system operating temperature is adopted. Examples of the resin include PTFE (polytetrafluoroethylene) and polyimide.

The parts coated with the resin are, for example, the outer circumferential surfaces of the respective bellows sections of the first to third bellows 41 to 43, liquid contact surfaces in the supply passage K1, the return passage K2, and the check valves 100*a* to 100*d* from the inner wall surface entire region of the second container 12 via the suction ports 21 and 23 and the delivery ports 22 and 24, and liquid contact surfaces in the first flange section 15*a* to which the end portion 41*a* of the first bellows 41 is fixed, the second flange section 15*b* to which the end portion 42*a* of the second bellows 42 is fixed, and the third flange section 15*c* to which the end portion 43*a* of the third bellows 43 is fixed in the shaft 15. Coating is applied by the conventional method for, for example, spraying and applying a resin material to a coating region.

The coating region is desirably regions of all parts that are likely to come into contact with the liquid L. However, at least movable parts in the system, that is, parts where relative movement with the liquid L including the slurry actively occurs in the system are desirably covered.

According to this embodiment, the low temperature brittle temperature of the resin for coating the liquid contact region of the system is lower than the system operating temperature. Therefore, it is possible to maintain elasticity during use. It is possible to suppress the components of the system from being damaged because the components are deformed with respect to the slurry that, for example, collides according to the relative movement with the liquid L. In particular, when the respective bellows expand and contract in the pump operation, collision of the slurry included in the liquid L and the bellows surfaces and damage to the bellows due to biting of the slurry in the bellows sections are suppressed.

When the bellows is made of metal, heat is less easily transferred to the liquid L when the coating resin is in contact with the liquid L than when the bellows made of metal is directly in contact with the liquid. When a liquid feed target is ultra-low temperature liquid, it is possible to suppress a temperature rise of the liquid L and maintain the liquid L in a low-temperature state.

Note that a resin coating layer does not need to adhere to the coated parts. In particular, a void may be present between the resin coating layer and the metal surface of the bellows. That is, damage to the system components due to contact and collision with the slurry only has to be reduced. Therefore, when all the liquid contact regions in the system are coated with the resin, the liquid L circulates in a bag of the resin.

In the conventional pump configuration shown in FIG. 5, resin coating is also necessary on the inner circumferential sides of the bellows sections. On the other hand, in the pump configuration in this embodiment, the liquid contact parts of the bellows are only the outer circumferential surfaces of the bellows sections. Therefore, the resin coating has to be applied to only the bellows section outer circumferential surfaces.

REFERENCE SIGNS LIST

10 Liquid supply system
11 First container
12 Second container
21 First suction port
22 First delivery port
23 Second suction port
24 Second delivery port
14 Linear actuator
15 Shaft
41 First bellows
42 Second bellows
43 Third bellows
51 Supporting member
52 Bellows
20 Cooler
30 Apparatus to be cooled
31 Container
32 Superconductive cable
K1 Supply passage
K2 Return passage
L Liquid
P1 First pump chamber
P2 Second pump chamber
R1 Closed space
C Resin coating region

The invention claimed is:

1. A liquid supply system that supplies an ultra-low temperature liquid including a slurry component by expansion and contraction of a bellows, wherein at least a region in the bellows that is in contact with the ultra-low temperature liquid is coated with resin which becomes brittle at a temperature that is equal to or lower than an operating temperature of the liquid supply system, further comprising:

a container configured to suck the ultra-low temperature liquid from a first passage communicating with an outside of the system and deliver the sucked ultra-low temperature liquid to a second passage communicating with the outside of the system;

a first bellows and a second bellows disposed in series in an expanding and contracting direction in the container, respective first end portions which are on sides of the first bellows and the second bellows that are close to each other, are respectively fixed to inner walls of the container, and respective second end portions which are on sides of the first bellows and the second bellows that are far from each other, are respectively configured to be movable in the expanding and contracting direction; and a shaft is inserted through the inside of the container such that the second end portions of the first bellows and the second bellows are respectively fixed to the shaft, and which expands and contracts the first bellows and the second bellows by reciprocatingly moving in the expanding and contracting direction with a driving source, wherein an outer side of the first bellows in the container serves as a first pump chamber, and the first pump chamber is provided with a first suction port for sucking the ultra-low temperature liquid into the first pump chamber from the first passage and a first deliver delivery port for delivering the sucked ultra-low temperature liquid from the first pump chamber to the second passage, an outer side of the second bellows in the container serves as a second pump chamber, and the second pump chamber is provided with a second suction port for sucking the ultra-low temperature liquid into the second pump chamber from the first passage and a second delivery port for delivering the sucked ultra-low temperature liquid from the second pump chamber to the second passage, a closed space is formed inside the first bellows and the second bellows, and at least a region in the first bellows that faces the first pump chamber and a region in the second bellows that faces the second pump chamber are coated with the resin which becomes brittle at the temperature that is equal to or lower than the operating temperature of the liquid supply system.

2. The liquid supply system according to claim 1, wherein the ultra-low temperature liquid is liquid nitrogen.

3. The liquid supply system according to claim 1, further comprising a third bellows disposed in series to the second bellows in the expanding and contracting direction, and having one end portion fixed to the container and the other end portion connected to the second end portion of the second bellows such that an outer side of the third bellows serves as the second pump chamber and an inner side thereof is opened to an outside of the container, the third bellows expanding and contracting according to the expansion and the contraction of the second bellows, wherein the shaft is inserted through the inner side of the third bellows and connected to the second end portion, and a region in the third bellows that faces the second pump chamber is also coated with the resin.

4. The liquid supply system according to claim 1, wherein the ultra-low temperature liquid is liquid helium.

* * * * *